US005823756A

United States Patent [19]

Kawazoe

[11] Patent Number: 5,823,756

[45] Date of Patent: Oct. 20, 1998

[54] SCROLL FLUID DISCHARGING APPARATUS

[75] Inventor: Shinji Kawazoe, Yokohama, Japan

[73] Assignee: Anest Iwata Corporation, Tokyo, Japan

[21] Appl. No.: 777,195

[22] Filed: Dec. 27, 1996

[30] Foreign Application Priority Data

Dec. 28, 1995 [JP] Japan ..... 7-352526

[51] Int. Cl.[6] ..... F04C 18/00

[52] U.S. Cl. ..... 418/55.4; 418/142; 277/81 R; 277/204

[58] Field of Search ..... 418/55.4, 142; 277/81 R, 204, 216

[56] References Cited

U.S. PATENT DOCUMENTS

| | | | |
|---|---|---|---|
| 4,722,676 | 2/1988 | Sugimoto | 277/204 |
| 5,145,345 | 9/1992 | Barito | 418/55.4 |
| 5,362,217 | 11/1994 | Jetzer et al. | 418/55.4 |

FOREIGN PATENT DOCUMENTS

| | | | |
|---|---|---|---|
| 6-307355 | 1/1994 | Japan | 418/55.5 |

*Primary Examiner*—John T. Kwon

*Attorney, Agent, or Firm*—Evenson, McKeown, Edwards & Lenahan, P.L.L.C.

[57] ABSTRACT

In a scroll fluid discharging apparatus including a stationary scroll and a revolving scroll, each of the mutually engaging laps and of these scrolls and each has a first lap portion without a tip seal in contact with the mirror-finished opposed scroll surface, thus providing an empty tip seal groove space, the first lap portion covering a predetermined lap length from the edge of the lap on the peripheral side thereof toward the central side. Each of the mutually engaging laps of the scroll also has a second lap portion with a tip seal in contact with the mirror-finished opposed scroll surface, the second lap portion having the remaining lap range from the first lap portion being neighboring each other up to the central side lap edge. Compressed fluid is discharged under a higher discharge pressure than in the prior art with the same drive motor rating and at the same motor rpm as in the prior art.

4 Claims, 10 Drawing Sheets

SCROLL FLUID DISCHARGING APPARATUS

BACKGROUND OF THE INVENTION

1. Field of the Invention

This invention relates to scroll fluid discharging apparatus, which discharge fluid is compressed in sealed spaces that are formed by mutually engaging scroll laps which are at a predetermined deviation angle from each other as the sealed spaces are progressively reduced in volume while proceeding from the side of a peripherally provided suction port toward a centrally provided discharge port.

2. Description of the Prior Art

In the usual scroll mechanism, sealed spaces are formed by scroll laps. To maintain the fluid tightness of the sealed spaces and ensure durability of the scroll laps, a tip seal 31B as shown in FIG. 11, which is made of a self-lubricating material, is fitted in a tip seal groove 13*a* (or 21*a*) (FIG. 2) that is formed in the tip of the lap 13 (or 21) of a stationary (or revolving) scroll 10 (or 20), and the lap 13 (or 21) is thus in frictional contact with a mirror-finished opposed scroll surface 10*a* (or 20*a*) via the tip seal 31B.

This scroll mechanism is applicable to a scroll fluid discharging apparatus as shown in FIG. 2.

The scroll discharging apparatus shown in FIG. 2 comprises a stationary scroll 10 and revolving scroll 20. The stationary scroll 10 has a lap 13 formed in a hollow space 12 surrounded by its peripheral wall 11. The revolving scroll 20 has a lap 21 that is engaged with the stationary scroll lap 13. The revolving scroll 20 is revolved relative to the stationary scroll 10 without being rotated, thus causing sealed spaces formed between the laps 13 and 21 to be progressively compressed with the progress of the sealed spaces from the side of a peripherally provided suction port toward centrally formed discharge port of the apparatus.

The revolving scroll 20 is revolved with a fixed radius of revolution about the center of the stationary scroll lap 13, causing points of contact between the laps 13 and 21 forming the sealed spaces which function as compression chambers to gradually proceed toward the apparatus center. As fluid is sucked through a suction port 16, it is led along an outer end portion of the lap 21 and trapped in a sealed space which is eventually formed by the two laps 13 and 21. With the revolving of the revolving scroll 20, the sealed space is progressively reduced in volume while proceeding toward the apparatus center, thus compressing the fluid trapped in it. The sealed space 22 is eventually communicated with the discharge port 17, whereupon the compressed fluid is discharged to the outside.

In the above apparatus, in order to improve the compression efficiency it is very important to ensure reliable sealed state of the sealed spaces formed by the laps 13 and 21.

Accordingly, the tip seal 31B of a self-lubricating material is fitted in the top of each lap such that it is in frictional contact with the opposed lap sliding surface, i.e., the mirror-finished opposed scroll body, as shown in FIG. 11.

As shown in FIG. 2, the involute lap 13 (or 21) is provided on a mirror-finished scroll surface 10*a* (or 20*a*) of the stationary (or revolving) scroll 10 (or 20), and the tip seal 31B is fitted in the tip seal groove 13*a* (or 21*a*), which is formed in the tip of the lap 13 (or 21) and is extending from a central part toward the periphery of the scroll.

As shown in FIG. 2, a ring-like dust seal 32 which is a containment material of self-lubricity, is fitted in a dust seal groove, i.e., a circle-like hollow groove formed in the scroll body of the stationary scroll 10 in contact with the scroll body of the revolving scroll 20 which is located in the peripheral wall of hollow space 12. The dust seal 12 serves to maintain the gas tightness between the hollow space 12 and the outside, and prevents from suction of external air and dust particles.

The scroll fluid discharging apparatus having the above construction is operable to discharge the compressed gas under a pressure of 8 kgf/cm$^2$.

Up to date, however, high discharge pressures of 10 kgf/cm$^2$ and above are required.

To meet this demand, i.e., to increase the discharge pressure, with the same rate of initial stage suction from the scroll mechanism periphery and with the same rpm, it is necessary to further compress the compressed gas in the final state compression chamber together with succeeding sucked gas. This increases the load, leading to excessive drive power, and requires increasing the rating of the scroll mechanism driving motor, which results a cost increase.

In addition, increasing the discharge pressure by reducing the scroll rpm with the same motor rating, results in insufficient cooling of heat generated by the compression of fluid due to reduction of the rpm of cooling fans which is directly coupled to the scroll drive shaft, which reduces the durability.

To increase the discharge pressure by using a drive motor of the same rating and at the same motor rpm as in the prior art, it is conceivable to reduce the lap turns number. Reducing the lap turns number, however, increases the pressure difference between the outer and inner periphery side sealed spaces, thus increasing leakage from the inner periphery side to the outer periphery side and greatly reducing the rate of supply of gas to the central part of the apparatus.

OBJECT AND SUMMARY OF THE INVENTION

In view of the above background, the invention has an object of providing a scroll fluid discharging apparatus, which permits increasing the discharge pressure of compressed gas by using a motor of the same rating as in the prior art and with a simple construction.

Another object of the invention is to provide a scroll fluid discharging apparatus, which permits compressed gas pressure increase without cost increase.

One feature of the invention resides in a scroll fluid discharging apparatus, which comprises a plurality of scrolls with laps formed on scroll bodies cooperating with each other, a suction port being provided peripherally for sucking fluid and a discharge port being provided centrally for discharging a compressed fluid, which has been compressed in sealed spaces formed by driving scroll laps with mutually engaging the tips of above scroll laps in contact via tip seals with mirror-finished opposed scroll surface, whereupon the sealed spaces are progressively reduced in volume thereof while proceeding from the side of the suction port toward the discharge port to be discharged, the mutually engaging scroll laps each having a first lap portion without tip, which the tip of scroll laps facing with mirror-finished opposed scroll surface on each above laps periphery, thus providing an empty portion in the tip seal groove portion irrespective of compression of fluid within a predetermined range from the edge of the lap on the peripheral side thereof toward the central side, and a second lap portion with the tip seal in the tip seal groove, having the remaining lap range portion from the first lap portion being each other, which being extending in contact with the mirror-finished opposed scroll surface toward the central side lap edge.

According to the invention as shown, the mutually engaging scroll laps each have a portion without tip seal, which the tip of scroll laps being in contact with the mirror-finished opposed scroll surface, which portion covers a predetermined lap length from the edge of the lap on the peripheral side thereof toward the central side, fluid flowing into the apparatus as shown by arrow 51T in FIG. 8(E) turns to be trapped in a space T1 to be eventually sealed as shown in FIG. 8(F). The space is eventually sealed as shown in FIG. 8(H) to complete the trapping of the fluid. The sealed space subsequently becomes a space T4 as shown in FIG. 7(A), whereupon compression of the trapped fluid commences. Since the stationary scroll lap 13 comprises the first lap portion LO1 without tip seal 31A, which is from the lap edge 21*b* on the peripheral side of the lap to the tip seal edge 3lA*a* on the same side, and the second lap portion L02 with tip seal 31A in contact with the mirror-finished opposed scroll surface for forming a sealed space, while the space T4 is compressed as shown in FIGS. 7(B) to 7(D), fluid leaks through a clearance M (in FIG. 6(*a*)) or G (in FIG. 6(*b*)) between the tip of the lap 13 and the mirror-finished surface of the revolving scroll 20 as shown by arrow 54T.

In the case of FIG. 6(*a*), fluid is allowed to pass to the right through the clearance between the tip of the lap 13' and the mirror-finished surface of the revolving scroll 20', that is, it leaks from the left high pressure side to the right low pressure side.

According to the invention, it is also effective means that the empty tip seal groove space in the first lap portions LF1 and LO1 can receive a tip seal extension in the lap length direction.

In the case of FIG. 6(*b*), fluid entering the empty tip seal groove space in the first lap portion LO1 of the lap 13 through the high pressure side of clearance G between the tip of lap 13 and the mirror-finished opposed surface of revolving scroll 20, leaks out to the low pressure side through the other clearance G between the lap tip and the mirror-finished surface. In the case of FIG. 6(*a*) which concerns a scroll fluid discharging apparatus without tip seal groove, fluid leaks through the clearance M with a dimension N between the tip of lap tip 13' and the mirror-finished surfaced of scroll mirror-surfaced 20'. In the case of FIG. 6(*b*) in which the empty tip seal groove space is provided, compared to the case of FIG. 6(*a*), fluid readily flows through the high pressure left side small dimension clearance into the tip seal groove 13*a* and thence readily leaks out through the low pressure right side small dimension clearance. In this case, a greater amount of fluid can leak.

Besides, compressed fluid entering the empty tip seal groove space flows along the groove in the longitudinal direction thereof toward the groove end, and thus can readily leak to the peripheral side of the lap.

The space T4 as shown in FIG. 7(A) becomes successive spaces T5 (FIG. 7(B) to T7 (FIG. 7(D) and then a sealed space T8 as shown in FIG. 8(E) formed by the second lap portion L02.

This means that the fluid which is trapped in the sealed space T8 is less in amount compared to the case, in which the empty tip seal groove space in the first lap porion LO1 is occupied by tip seal.

The sealed space T8 is compressed progressively to a space T24 as shown in FIG. 8(E) before being communicated with the discharge port 17 (FIG. 8(F)).

When the fluid pressure in the discharge port 17 is higher than the fluid pressure in the space T25 (FIG. 8(F)), the fluid in the discharge port 17 flows back into the space T25 and is compressed together with the fluid therein with progressive volume reduction of the space to T27 (FIG. 8(H)) to T29 (FIG. 7(B)). When the pressure in the discharge port 17 is exceeded during this time, the compressed fluid is discharged through the discharge port.

Since the trapped fluid is less in amount compared to the case of the presence of tip seal occupying the empty tip seal groove space in the first lap portion LO1, the compression of fluid up to a predetermined pressure takes a longer time than the time taken for increasing the discharge pressure up to 8 kgf/cm$^2$. However, with the simple construction that an empty tip seal groove space is provided in a lap tip portion adjacent the peripheral side lap edge, that is, a suction side empty tip seal groove space is provided irrespective of compression of fluid, it is possible to discharge compressed fluid under a higher discharge pressure than in the prior art with the same drive motor rating and the same motor rpm as in the prior art.

With the empty tip seal groove space provided in the first lap portion tip, it is possible to obtain the compressed fluid discharge pressure increased with the same drive motor rating as in the prior art by designing the dimensions of the stationary and revolving scrolls, the radius of revolving of the revolving scroll and so forth as in the prior art 8 kgf/cm$^2$ case.

Besides, without reducing the motor rpm sufficient cooling effects by cooling fans can be expected, and the same motor as in the prior art can be used.

Suitably, the first lap portion covers a lap length of 125 to 290 mm from the peripheral side lap edge. Also suitably, denoting the length of the first lap portion from the peripheral side lap edge by Sg and the length from the central tip edge of tip seal to the peripheral side lap edge of the first lap portion by Sa, Sg/Sa=0.15~0.35.

With this construction, the compressed fluid discharge pressure can be increased without altering the scroll mechanism drive motor rating as shown in FIG. 10.

According to the invention comprising a plurality of scrolls with laps formed on scroll bodies each other, it is further effective to have a tip seal fitted in a tip seal groove formed in the tip of each lap such that it is in frictional contact with the mirror-finished opposed scroll surface, the tip seal being secured at the discharge port side of central end to the lap with 13*e* and 2l*e*.

As shown in FIG. 4(*b*), the tip seal 31A is secured at its central end to the lap 13 of the stationary scroll 10 by protuberances 13*e*, which are provided on the side wall surfaces of the tip seal groove 13*a*. Also, the tip seal 31A' is secured at its central end to the lap 21 of the revolving scroll 20 by protuberances 2l*e* provided on the side wall surfaces of the tip seal groove 21*a*. With the tip seals secured at their central end, which is the discharge port side particularly elevated to a high temperature in operation, by the protuberances 13*e* and 21*e*, it is possible to eliminate the possibility that the tip seals undergoing thermal expansion and contraction with temperature changes in the operation are detached from their grooves due to expansion beyond the peripheral lap end.

DETAILED DESCRIPTION OF THE PREFERRED EMBODIMENT

The invention will now be described in detail in conjunction with an embodiment thereof with reference to the drawings. Unless particularly specified otherwise, the dimensions, materials, shapes, relative positions, etc. of the components described in the embodiment, have no sense of limiting the invention, but are merely exemplary.

Figure 1:
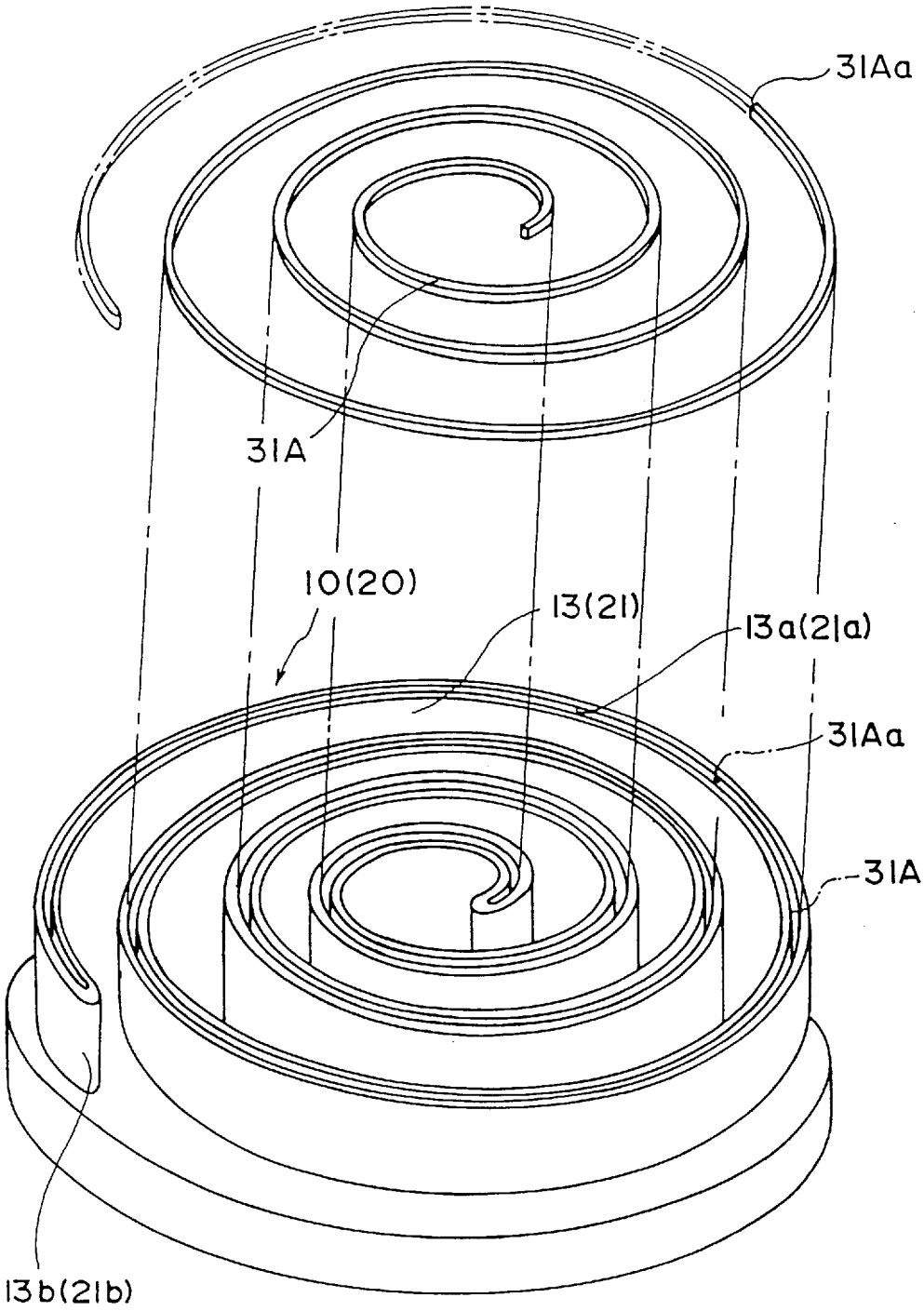
FIG. 1 is a view showing the relation between a tip seal and a scroll lap in the basic construction underlying the invention.
Figure 2:
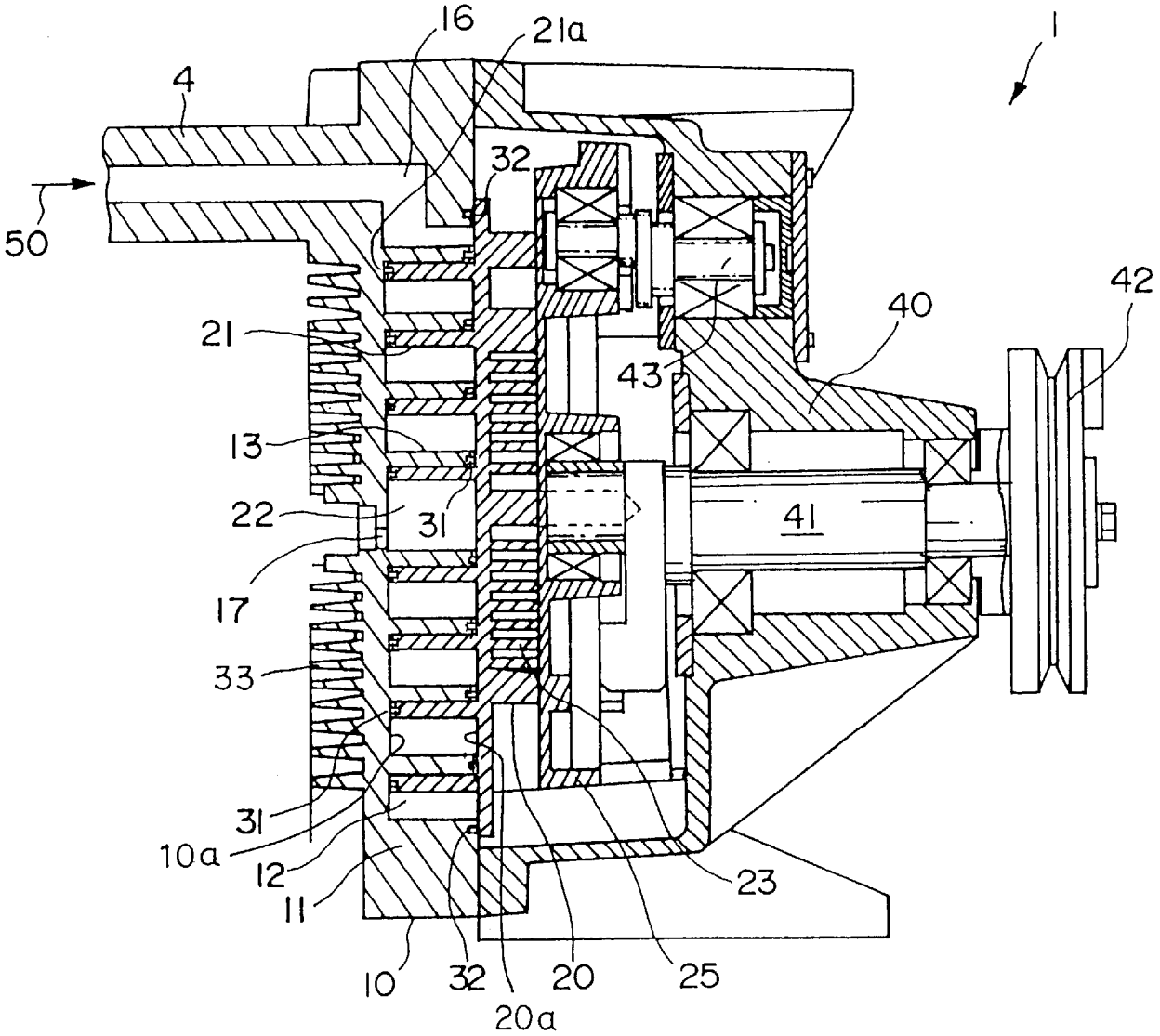
FIG. 2 is a sectional view showing an embodiment of the scroll fluid discharging apparatus according to the invention.

FIG. 1 is a view showing the relation between a tip seal and a scroll lap in the basic construction underlying the invention. FIG. 2 is a sectional view showing an embodiment of the scroll fluid discharging apparatus according to the invention.

Referring to FIG. 2, the illustrated scroll fluid discharging apparatus comprises a stationary scroll 10, a revolving scroll 20 and a frame 40. The stationary scroll 10 is secured to the frame 40, while the revolving scroll 20 is supported for revolving in the frame 40.

The stationary scroll 10 has a peripheral wall 11, which is secured to an end surface of the frame 40 and has a suction port 16, a lap 13 which has an involute form and is formed in a hollow space 12 defined by the peripheral wall 11, and a substantially centrally provided discharge port 17 for discharging compressed fluid.

The revolving scroll 20 is accommodated in a hollow space defined by the frame 40, and has a lap 21 having substantially the same involute form as the lap 13 of the stationary scroll 10. The lap 21 is formed on one surface of a disc-like portion the upper surface of with the peripheral wall 11 noted above. The laps 13 and 21 engage each other.

The scrolls 10 and 20 have cooling fins 33 and 23 formed on their back sides for cooling their inside by air cooling.

Figure 11:
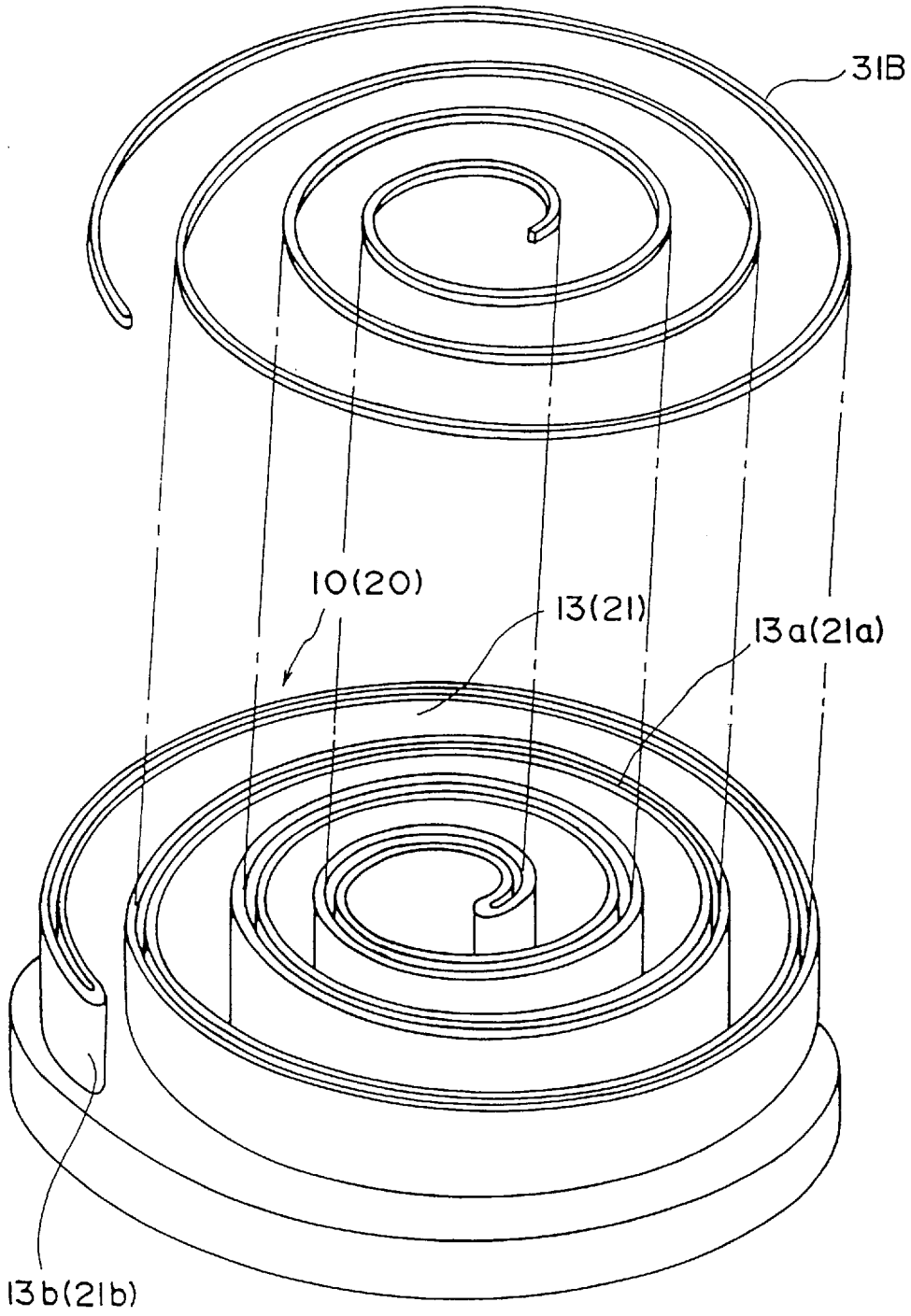
FIG. 11 is a view showing the relation between a tip seal and a scroll lap in a related technique.

A self-lubricating seal material, which may be the tip seal 31A shown in FIG. 1 or the tip seal 31B shown in FIG. 11, is fitted in a tip seal groove formed in the tip of each of the scroll laps 13 and 21 and in frictional contact with the opposed scroll. The laps 13 and 21 thus can slide relative to each other by lubricating-free oil. A ring-like dust seal 32 which is a self-lubricating seal, is fitted in a dust seal groove formed hollowly in the end surface of the stationary scroll peripheral wall 11 and contacts the mirror-finished surface of the revolving scroll 20. The dust seal 32 maintains fluid tightness of sealed spaces formed by the laps 13 and 21 of the stationary and revolving scrolls 10 and 20 and prevents suction of external air and dust particles.

The frame 40 supports a coaxial drive crankshaft 41 with a pulley 42 mounted at one end, and also supports three driven crankshafts 43 provided at an angular displacement interval of by 120 degrees as centering around the drive crankshaft 41.(3 portions)

The crankshafts 41 and 43 are supported for rotation by a revolving scroll support housing 25 which is integral with the revolving scroll 20. With the rotation of the drive crankshaft 41, the revolving scroll 20, while not in rotation, is revolved with a fixed radius of revolving around the lap center of the stationary scroll 10.

A duct 4 is led from the suction port 16, and fluid is sucked in the direction of arrow 50 from a system (not shown) which is connected to the other end of the duct 14.

Figure 3A:
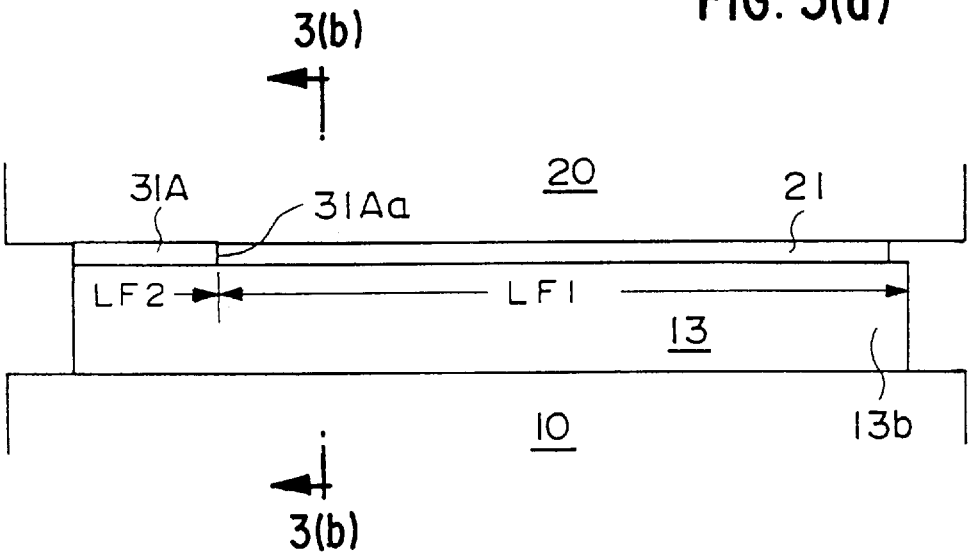
FIGS. 3(*a*) and 3(*b*) are views showing essential parts of the scroll mechanism according to the invention, FIG. 3(*a*) being a side view, FIG. 3(*b*) being a sectional view taken along line 3(*b*)—3(*b*) in FIG. 3(*a*)
Figure 3B:
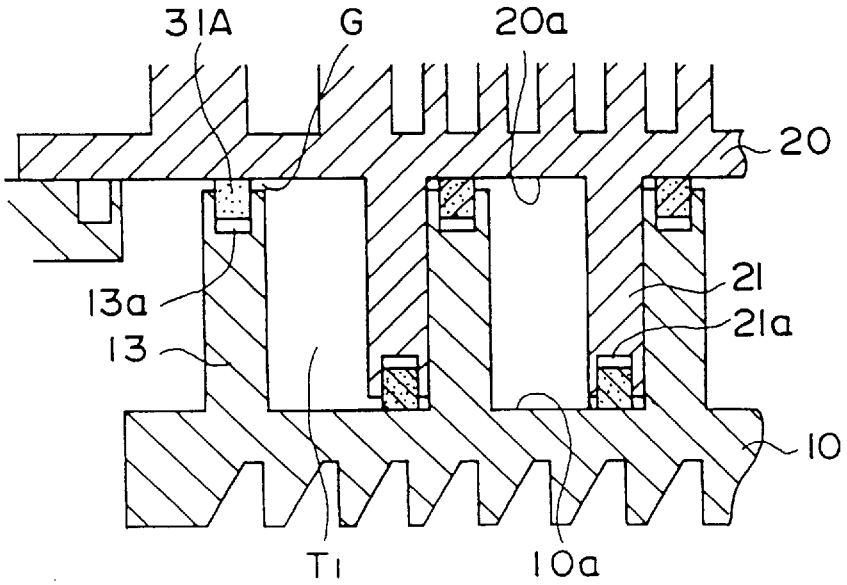

FIG. 3(*a*) is a view showing an essential part of the scroll mechanism according to the invention, and FIG. 3(*b*) is a sectional view taken along line A—A in FIG. 3(*a*).

Referring to Fig., 3(*a*), the lap 13 of the stationary scroll 10 comprises a first lap portion LF1 without tip seal in the tip seal groove 13*a* noted above, and a second lap portion LF2 with tip seal fitted in the tip seal groove 13*a*. Likewise, the lap 21 of the revolving scroll 20 comprises a first lap portion LO1 without tip seal in the tip seal groove (not shown), and a second lap portion L02 with tip seal fitted in the tip seal groove 21*a*.

Figure 4A:
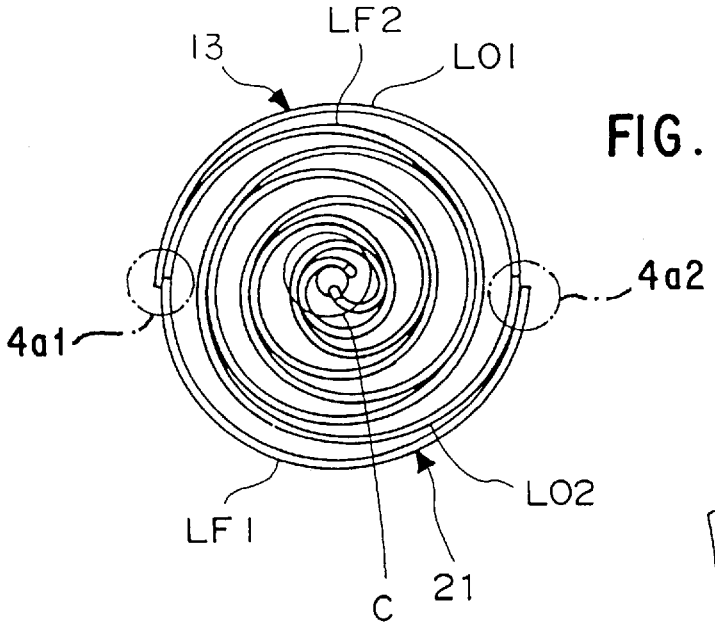
FIGS. 4(*a*)(1) and 4(*a*)(2) are views mainly showing end portions of tip seal grooves and tip seals, with FIG. 4(*a*) being a plan view, and FIG. 4(*a*)(1), FIG. 4(*a*)(2), and FIG. 4(*b*) enlarged-scale plan views showing parts A, B and C shown in FIG. 4(*a*)
Figure 4:
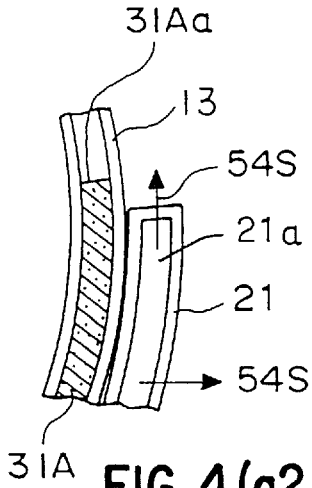
Figure 4:
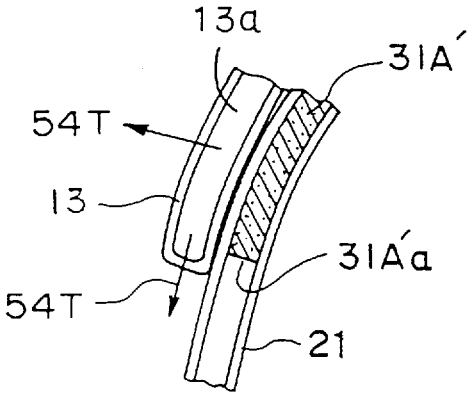
Figure 4B:
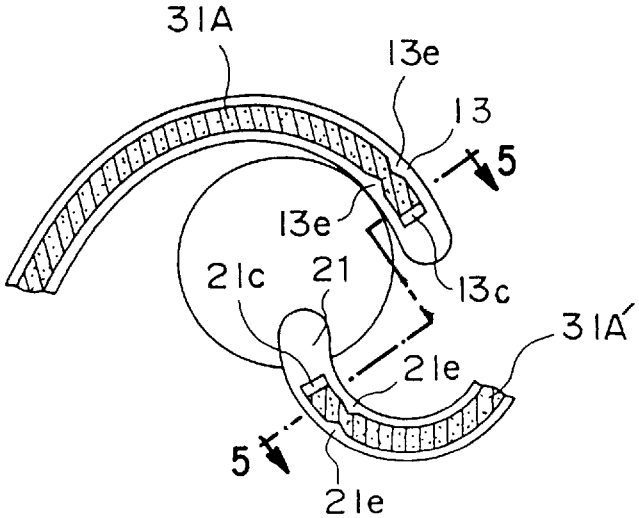
Figure 5:
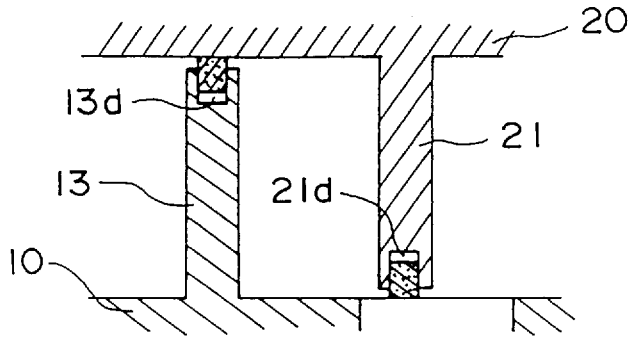
FIG. 5 is a sectional view taken along line 5—5 in FIG. 4(*b*)

FIG. 4(*a*) is a view showing end portions of tip seal grooves and tip seals. FIG. 4(*b*) is an enlarged-scale view showing a portion C in FIG. 4(*a*). FIG. 5 is a sectional view taken along line B—B in FIG. 4(*b*).

Referring to these figures, a tip seal 31A is secured at its central end to the lap 13 of the stationary scroll 10 by protuberances 13*e*, which are provided on the side wall surfaces of the tip seal groove 13*a*.

Also, a tip seal 13A' is secured at its central end to the lap 21 of the revolving lap 20 by protuberances 21*e* provided on the side wall surfaces of the tip seal groove 21*a*.

With the tip seals secured at their central end, which is the discharge port side particularly elevated to a high temperature in operation, by protuberances 13*e* and 21*e*, it is possible to eliminate the possibility that the tip seals undergoing thermal expansion and contraction with temperature changes in the operation and detached from their grooves due to expansion beyond the peripheral lap end.

Figure 6A:
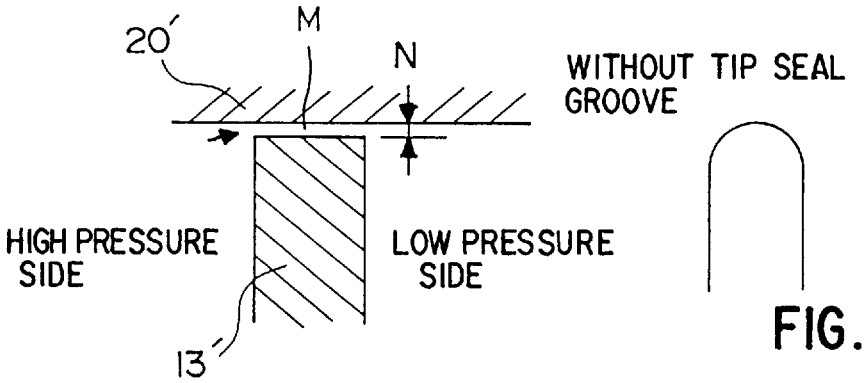
FIGS. 6(*a*) and 6(*b*) are views for describing leakage of fluid through lap clearances.
Figure 6B:
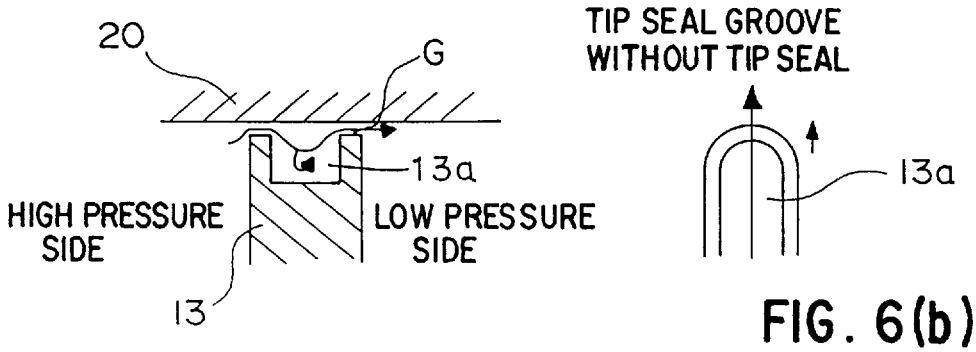
Figure 7:
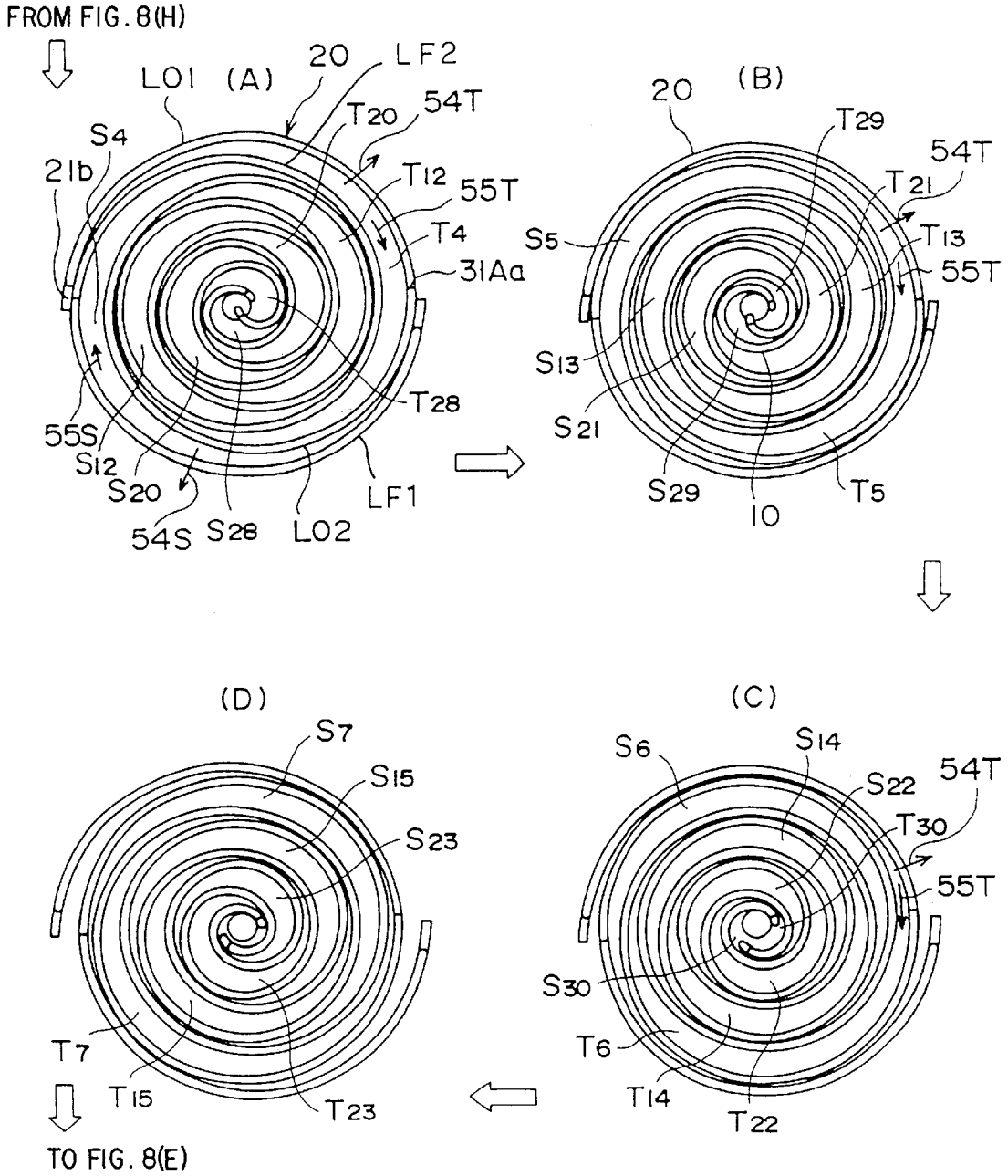
FIGS. 7(A) to 7(D) illustrate as schematic representation 1 the function of the scroll mechanism embodying the invention.

According to the invention, the mutually engaging scroll laps each have a portion without tip seal, with the tip of scroll laps facing the mirror finished opposed scroll surface, which portion covers a predetermined lap length from the edge of the lap on the peripheral side thereof toward the central side, as shown in FIG. 6(*a*), fluid is allowed to pass to the right through the clearance between the tip of the lap 13' and the opposed mirror-finished surface, that is, it leaks from the left high pressure side to the right low pressure side.

The empty tip seal groove space in the first lap portion LO1 noted above can receive a tip seal extension in the lap length direction, and this is effective to increase the leakage of fluid. Without tip seal occupying the empty tip seal groove space, as shown in FIG. 6(*b*), fluid entering to the tip seal groove through the clearance G between the tip of the lap 13 and the mirror-finished surface from the high pressure side (left side), leaks out to the low pressure side through the other clearance between the lap tip and the mirror-finished surface.

In the case of FIG. 6(*b*) in which the empty tip seal groove space is provided, compared to the case of FIG. 6(*a*) in which fluid leaks through the clearance M formed with space N between the tip of lap 13' and scroll 20', fluid readily flows through the high pressure side small dimension clearance into the top seal groove 13*a* and thence readily leaks out through the low pressure side small dimension clearance. In this case, a greater amount of fluid can leak.

Besides, compressed fluid entering the empty tip seal groove space flows along the groove in the longitudinal direction thereof toward the groove end, and thus can readily leak to the peripheral side of the lap.

Figure 8:
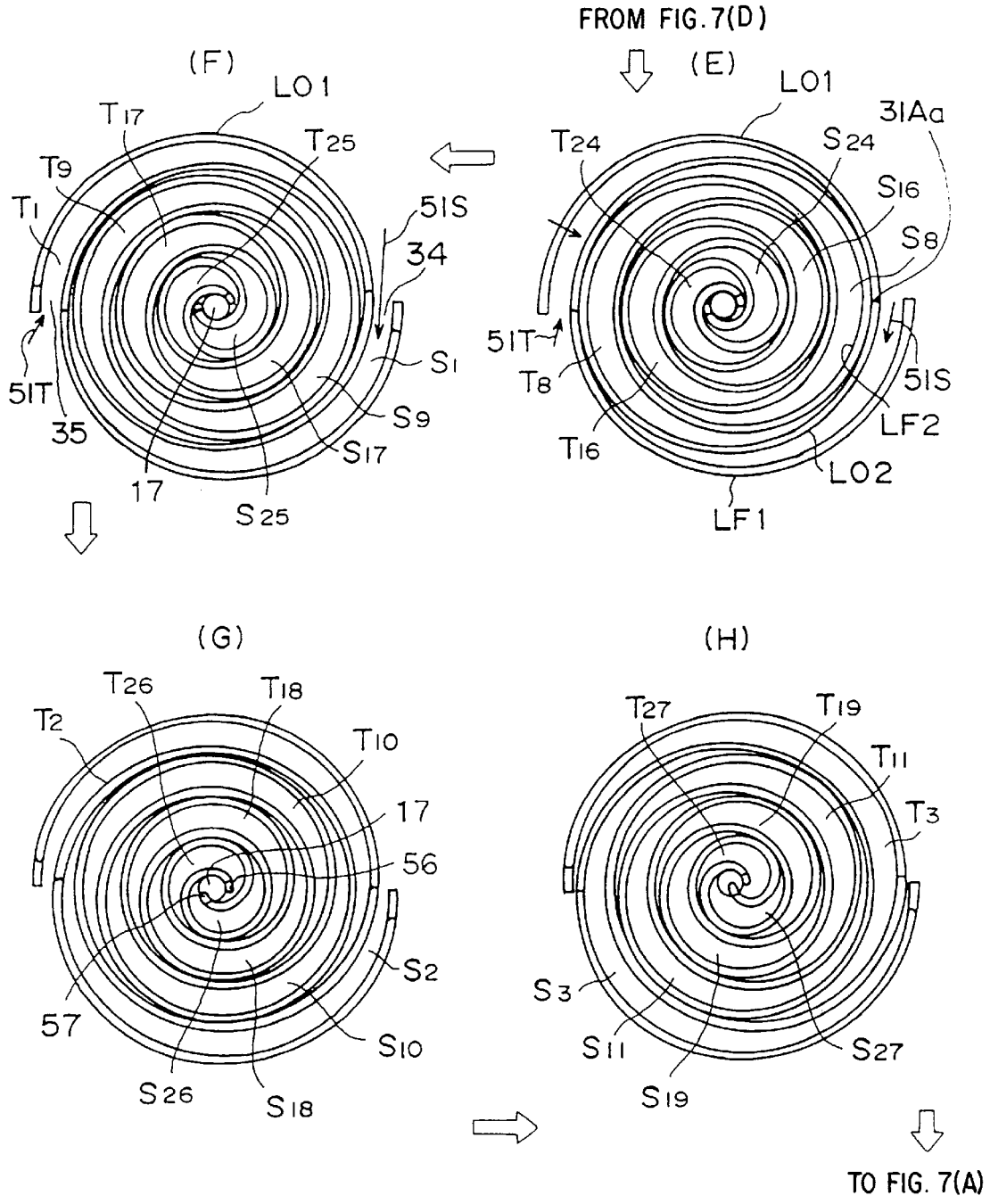
FIGS. 8(E) to 8(H) illustrate as schematic representation 2 the function of the scroll mechanism embodying the invention.

FIGS. 7(A) to 7(D) and 8(E) to 8(H) are schematic views showing together the scroll function according to the invention and the scroll function in a pertaining prior art technique. These figures show the positions and shapes of spaces formed by the stationary scroll 10 and the revolving scroll 20 revolving relative thereto on dividing the 360 degree's revolution of revolving scroll 20 into 8 equal parts. Successive positions from the position shown in FIG. 7(A) to the position shown in FIG. 8(H) are assumed in one cycle.

First, the scroll function in the pertaining prior art technique will be described with reference to FIGS. 7(A) to 8(H). As shown in FIG. 11, a tip seal 31B occupies the tip seal groove 13*a* (21*a*) in the lap 13 (21) in the scroll mechanism 1 up to the peripheral side lap edge. In this case, fluid sucked from the peripheral side of the scroll mechanism 1 in the operation thereof, is progressively compressed as it is led toward the central side and discharged through the discharge port 17 shown in FIG. 2.

With the revolving of the lap of the revolving scroll 20, fluid in space S1 shown in FIG. 8(F), having been sucked through an opening 34 communicating with the suction port 16 shown in FIG. 2, is tapped in space S2 in FIG. 8(G) and compressed with progressive volume reduction and proceeding of the space to S3 shown in FIG. 8(H) to S24 shown in FIG. 8(E) and to S25 in FIG. 8(F).

With subsequent revolving of the revolving scroll 20, changing the space S25 shown in FIG. 8(F) to space S26 shown in FIG. 8(G), the lap end 57 of the revolving scroll 20 is separated from the opposed side surface of the lap of the stationary scroll 10, thus communicating the space 8G with the discharge port 17.

At this moment, fluid which has been sucked through an opening 35 into space T1 is being discharged from space T26 shown in FIG. 8(G), and the fluid in the space S26 is discharged as following fluid.

With the revolving of the revolving scroll 20, the space S is progressively reduced in volume to S27 (FIG., 8(H), S28 (FIG. 7(A)), S29 (FIG. 7(B)) and S30 (FIG. 7(C)), and the discharge of fluid in the space T is ended in the position shown in FIG. 7(C).

Subsequently, the discharge of fluid in the space S is ended in the position shown in FIG. 7(D).

In the above operation of the scroll mechanism, compressed fluid is discharged under a discharge pressure of 8 kgf/cm$^2$.

Now, the scroll function will be described in connection with the case, in which a tip seal 31A shown in FIG. 1 is fitted in each of the laps 13 and 21 in the scroll mechanism 1.

The tip seal 31A is fitted in each of the tip seal grooves 13*a* and 21*a* of the laps 13 and 21 in the manner as shown in FIG. 3, which shows the tip seal fitted in the lap 13. As shown, the lap 13 comprises a first lap portion LF1 which is not occupied by the tip seal 31A facing the mirror-finished opposed scroll surface and forming a clearance G between the lap tip and the mirror-finished opposed scroll surface, the first lap portion LF1 covering a lap length from the peripheral side edge 3lA*a* of the tip seal 31A to the peripheral side edge 13*b* of the lap 13, and a second lap portion LF2 which is occupied by the tip seal 31A in the tip seal groove, the second lap portion LF2 covering the remaining lap length from the central side edge of the first lap portion LF1 to the central side lap edge.

With this construction, fluid flowing into the apparatus as shown by arrow 51T in FIG. 8(E) turns to be trapped in a space T1 to be eventually sealed as shown in FIG. 8(F). The space is eventually sealed as shown in FIG. 8(H) to complete the trapping of the fluid. The sealed space subsequently becomes a space T4 as shown in FIG. 7(A), whereupon compression of the trapped fluid commences. Since the stationary scroll lap 13 comprises the first lap portion LO1 without tip seal 31A, which is from the peripheral side edge 21*b* of the lap to the tip seal edge 3lA*a* on the same side, and the second lap portion L02 with the tip seal 31A in frictional contact with the mirror-finished surface of the stationary scroll 20 to form a sealed space, fluid leaks through a clearance G between the tip of the lap 13 and the mirror-finished stationary scroll surface as shown by arrow 54T, while also leaking through the empty tip seal groove space to the peripheral side of the lap as in FIG. 4(*a*).

The space T4 successively becomes spaces T5 (FIG. 7(B)) to T7 (FIG. 7(D)) and then space T8 (FIG. 8(E)) formed by the second lap portion L02.

Fluid trapped in the sealed space T8 is less than fluid which is trapped in the same space T8 by lap.

When the space progressively reduced in volume becomes a space T25 (FIG. 8(F)), it is communicated with the discharge port 17.

When the fluid pressure in the space T25 is higher than the fluid pressure in the discharge port, the fluid therein flows back into the space T25 and is compressed together with the fluid having previously been in the space T25 as the space T25 becomes successive spaces T26 (Fig. (G)) to T29 (FIG. 7(B)). When the pressure in the discharge port is exceeded during this time, the compressed fluid is discharged through the discharge port.

Meanwhile, fluid sucked into the apparatus as shown by arrow 51S in FIG. 8(E) turns to be trapped in a space S1 as shown in FIG. 8(F). The trapping of fluid is completed until the space becomes one as shown in FIG. 8(H). When the space becomes a space S4 as shown in FIG. 7(A), the fluid commences to be compressed. Since the stationary scroll lap 21 comprises the first lap scroll LF1 without tip seal 31A, which is from the peripheral side edge 13*b* of the lap to the tip seal edge 31A*a* on the same side, and the second lap portion LF2 with the tip seal 31A in frictional contact with the mirror-finished surface of the revolving scroll 20 to form a sealed space, as the space is progressively reduced in volume as shown in FIGS. 7(B) to 7(D), fluid leaks through the clearance G between the tip of the lap 21 and the mirror-finished surface of the stationary scroll 10 as shown by arrow 54S, while also leaking through the empty tip seal groove space to the peripheral side of the lap as shown in FIG. 4(*a*).

The space S4 becomes successive spaces S5 (FIG. 7(B)) to S7 (FIG. 7(D)) and then a space S8 (FIG. 8(E)) formed by the second lap portion LF2.

Fluid trapped in the sealed space T8 is less than fluid which is trapped in the same space T8 when lap portion LF1 is occupied by tip seal.

When the space S8 progressively reduced in volume becomes as a space S25 (FIG. 8(F)), it is communicated with the discharge port 17 as shown in FIG. 8(G).

As descried before, fluid trapped in the sealed space T8 is less than fluid which is trapped in the same space T8 when lap portion LF1 is occupied by tip seal of by lap portion LF1 without any tip seal groove formed in the lap tip, and it is thus possible to increase the discharge pressure from 8 to 10 kgf/cm$^2$ without resulting in excessive drive motor torque.

When the fluid pressure in the discharge port is higher than the fluid pressure in the space S26, fluid in the discharge port flows back to the space S26, and is compressed together with fluid having previously been in the space S26 which becomes successively reduced volume spaces S27 (FIG. 8(H)) to S30 (FIG. 30(C)). When the fluid pressure in the discharge port is exceeded during this time, the compressed fluid is discharged through the discharge port.

It is thus possible to prevent application of higher fluid pressure than is necessary to the discharge port, thus preventing drive power increase and obtaining discharge of compressed fluid under a higher discharge pressure than in the prior art with the same drive motor rating and at the same motor rpm as in the prior art.

In addition, with a simple construction that the lap has a portion without tip seal on the peripheral side, the amount of trapped fluid can be reduced compared to the case where tip seal is present in the first lap portion LF1 (LO1) and also the case without any tip seal formed in the lap tip, thus permitting discharge of compressed fluid under a higher discharge pressure than in the prior art and at the same motor rpm as in the prior art.

With the empty tip seal groove space provided in the first lap portion tip irrespective of fluid compression, it is possible to obtain the compressed fluid discharge pressure increase with the same drive motor rating as in the prior art by designing the dimensions stationary of the and revolving scrolls, the radius of revolving of the revolving scroll and so forth as in the prior art 8 kgf/cm$^2$ case.

Moreover, without motor rpm reduction the rpm of cooling fans directly coupled to the scroll drive shaft is not reduced, so that sufficient cooling effects can be obtained. It is thus possible to use the same motor as in the prior art.

Although not shown in the above embodiment, a check valve may be provided in the discharge port such that it can be opened when a predetermined pressure is reached.

As has been described, in the above embodiment, each of the second lap portions LF2 and L02 of the laps 13 and 20 is in frictional contact with the mirror-finished opposed scroll surface via the tip seal 31A, while each of the first lap portions LF1 and LO1 without tip seal forms a clearance between its lap tip and the mirror-finished surface.

That is, the tip seal 31A fitted in the tip seal groove is obtained after cutting a portion by phantom lines shown in FIG. 1. In the first lap portions LO1 and LF1, clearances G and N are thus formed between their tips and the mirror-finished opposed scroll surfaces 13*a* and 20*a* (FIG. 3). Sucked fluid thus can readily leak through the clearances N and G between the lap tips and the mirror-finished surfaces to the low pressure side. In addition, where the empty tip seal groove spaces are provided in the first lap portions LF1 and LO1, compressed fluid flows through the empty tip seal groove spaces to the peripheral low pressure side of the lap, thus fluid can leak as soon as it is sucked.

Thus, less fluid is sucked, and less fluid is discharged. It is thus possible to increase the pressure under which compressed fluid is discharged from 8 to 10 kgf/cm$^2$ without resulting in excessive drive torque.

By preparing tip seals which are reduced in length compared to the prior art tip seal, it is possible to increase the discharge pressure with the same drive motor rating and the same motor rpm as in the prior art and with a simple construction.

Suitably, the first lap portions LF1 and LO1 have a length of 125 to 290 mm from the peripheral side lap edge, or denoting the length of the first lap portions from the peripheral side lap edge 13*b* (21*b*) by Sg and the length from the central side tip seal edge of tip seal to the peripheral side lap edge of first lap portion by Sa, Sg/Sa ranges from 125/835 mm to 290/835 mm, i.e., 0.15 to 0.35.

Preferably, the first lap portions LF1 and LO1 have a length of 125 to 250 mm from the peripheral side lap edge, or Sg/Sa ranges from 0.15 to 0.3.

The basic embodiment has such a further advantage, which with the tip seals fitted in the tip seal grooves formed in the tips of plurality of the scroll laps and such as to be in frictional contact with the mirror-finished opposed scroll surfaces and secured at their discharge port side ends, i.e., at their ends on the central side of the scroll mechanism particularly elevated to a high temperature in operation, by the protuberances 13*e* and 21*e*, it is possible to eliminate the possibility that the tip seals undergoing thermal expansion and contraction with temperature changes in the operation are detached from their grooves due to expansion beyond the peripheral lap end.

Moreover, while the above embodiment concerned with the scroll fluid discharging apparatus using the single lap revolving scroll together with the stationary scroll, which has no sense of limiting thereof, the invention is also applicable to a scroll fluid discharging apparatus, which uses a double lap discharging apparatus with laps on both sides of revolving scroll body, and further to a scroll fluid discharging apparatus of both scroll driving type with a drive and a driven scroll.

EXAMPLE

Using the apparatus 1 (FIG. 2), the rate L/min (liters/min.) of discharge of air from the discharge port and the motor power when the compressed air discharge pressure reaches 10 kgf/cm$^2$, were measured by setting the involute lap length from the central side to the peripheral side to 8.5π and by cutting appropriate peripheral side length off the tip seal with a maximum length of 835 mm.

Figure 9:
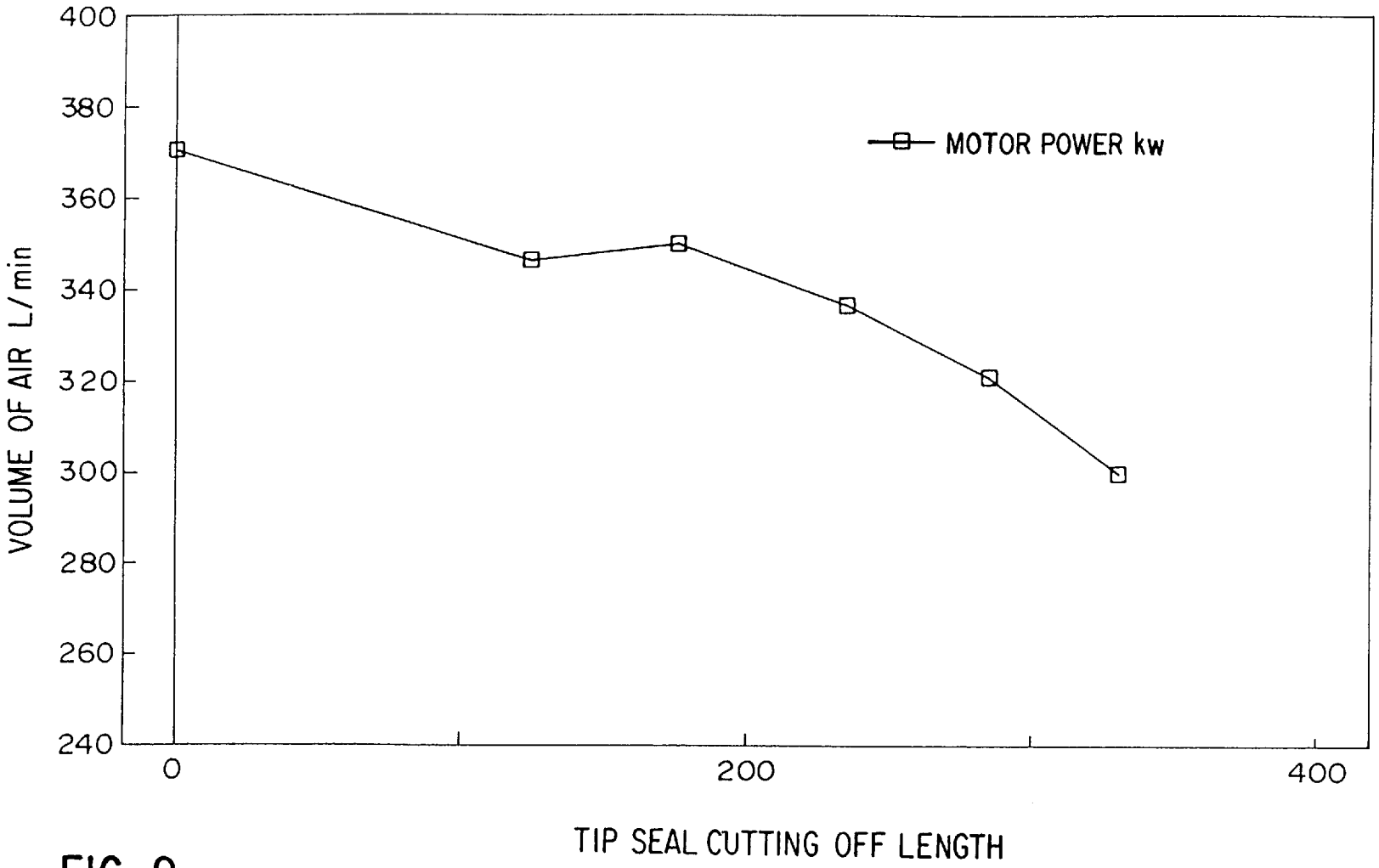
FIG. 9 is a diagram showing the relation between discharge pressure and empty tip seal groove space length.
Figure 10:
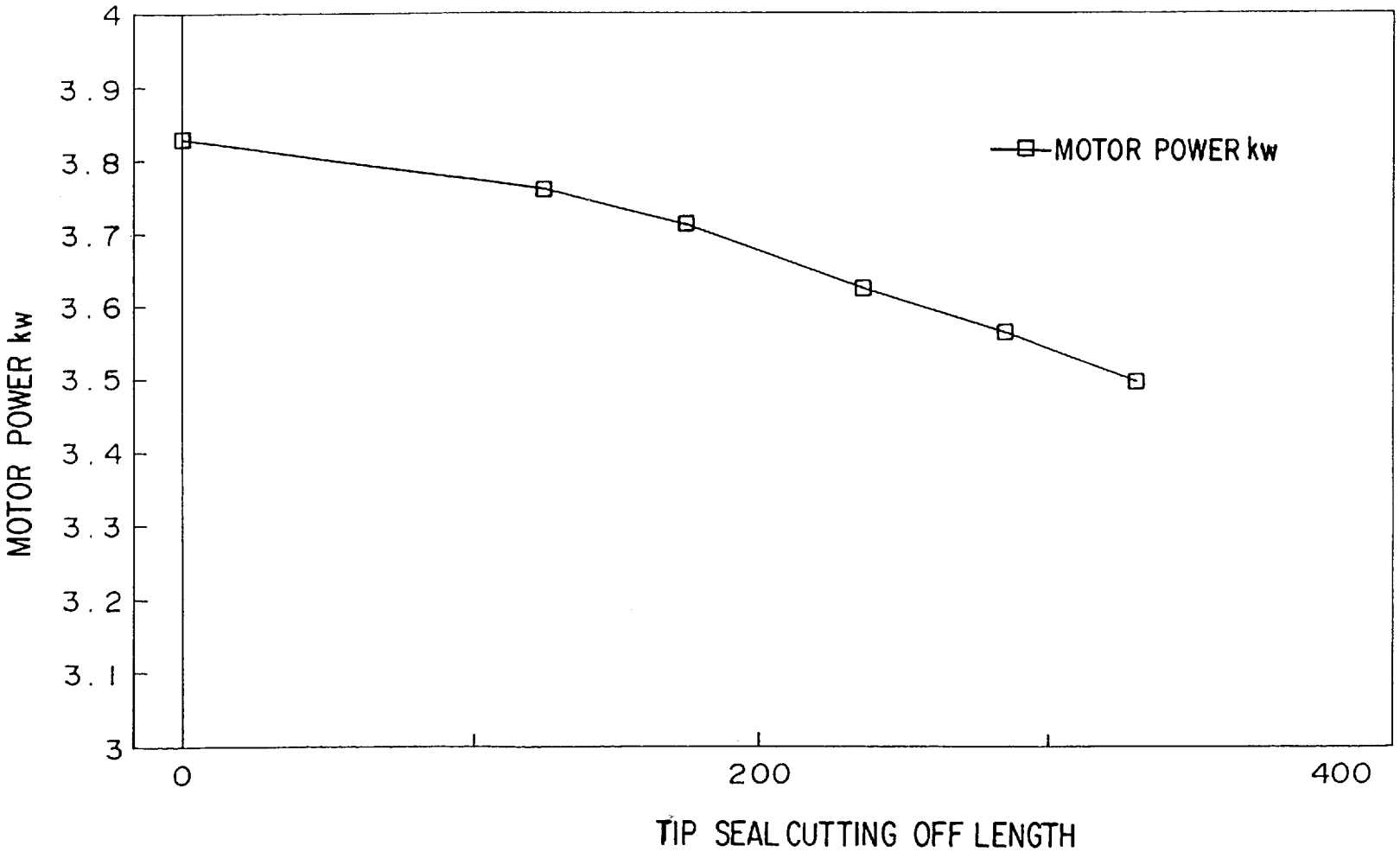
FIG. 10 is a diagram showing the relation between discharge pressure and empty tip seal groove space length.

FIG. 9 is a graph showing the measured air discharge rate L/min (liters/min.) plotted as ordinate axis data, the abscissa being taken for the tip seal length (mm) after the cutting. FIG. 10 is a graph showing the measured motor power (kW) when the compressed air discharge pressure reaches 10 kgf/cm$^2$ plotted as the ordinate axis data, the abscissa axis being taken for the tip seal length (mm) after the cutting.

As shown in FIG. 9, by providing the empty tip seal groove space it is possible to reduce the air discharge rate and maintain the compressed air discharge pressure of 10 kgf/cm$^2$.

By cutting off a tip seal length of 125 to 290 mm, an air discharge rate of 350 to 320 liters/min. (L/min.) can be obtained. Particularly, by cutting off a tip seal length of 125 to 230 mm liters/min, an air discharge rate of 340 to 350 liters/min. can be obtained.

As shown in FIG. 10, by providing the empty tip seal groove space it is possible to maintain the increased compressed air discharge pressure of 10 kgf/cm$^2$ with the same drive motor power as in the prior art.

The tip seal length cutting-off range of 125 to 290 mm corresponds to a drive motor power range of 3.76 to 3.56 kW. A drive motor with a rated drive torque in this range thus may be selected.

As has been described in the foregoing, according to the invention it is possible by using a motor having the same rating as in the prior art to provide a scroll fluid discharging apparatus, which permits increasing the discharge pressure and discharge rate of compressed fluid with the same motor rpm as in the prior art and with a simple construction.

What is claimed is:

1. A scroll fluid discharging apparatus comprising:

a plurality of scrolls with scroll laps formed on scroll bodies facing each other, a suction port being provided peripherally for sucking fluid into the apparatus, and a discharge port being provided centrally for discharging fluid from the apparatus, tip seals at tips of said scroll laps in contact with mirror-finished opposed scroll surfaces, said fluid being compressed in sealed spaces formed by the tip seals and the mirror-finished opposed scroll surfaces during relative movement of said scrolls, the sealed spaces being progressively reduced in volume thereof while proceeding from said suction port toward said discharge port to discharge said fluid, each of said scroll laps having a tip seal groove defined along its tip within which one of said tip seals is received, a first lap portion without a tip seal between its tip and the mirror-finished opposed scroll, thus providing an empty portion avoiding compression of fluid, over a predetermined range from an end of the lap on its outer peripheral side along the lap toward a central side, and a second lap portion with the tip seal in said tip seal groove extending from said predetermined range over a remaining portion of the lap and neighboring the first lap portion, said tip seal being in contact with the mirror-finished opposed scroll surface along the second lap portion, said first lap portion having a minimum length such that a ratio of said minimum length to a length (Sa) between a central side tip seal edge and a peripheral side lap edge of the first lap portion is no less than about 0.15.

2. The scroll fluid discharging apparatus according to claim 1, wherein the tip seal is fitted in each tip seal groove such that it is in frictional contact with the mirror-finished opposed scroll surface and is secured at a discharge port side of a central end thereof to the second lap portion.

3. The scroll fluid discharging apparatus according to claim 1, wherein said first lap portion covers a lap length of 125 to 290 mm from the edge of the lap on the outer peripheral side of the lap.

4. The scroll fluid discharging apparatus according to claim 1, wherein said first lap portion has a length (Sq) such that a ratio (Sq/Sa) of the length (Sq) to the length (Sa) between the central side tip seal edge and the peripheral side lap edge of the first lap portion ranges from 0.15 to 0.35.

* * * * *